US007975484B1

(12) United States Patent
Burns et al.

(10) Patent No.: US 7,975,484 B1
(45) Date of Patent: Jul. 12, 2011

(54) APPARATUS AND METHOD FOR MONITORING STEAM CONDENSER AIR INLEAKAGE

(76) Inventors: John M Burns, Topsfield, MA (US); Daniel C Burns, Cary, NC (US); Jeffrey S Burns, Salem, MA (US)

( * ) Notice: Subject to any disclaimer, the term of this patent is extended or adjusted under 35 U.S.C. 154(b) by 781 days.

(21) Appl. No.: 12/011,441

(22) Filed: Jan. 25, 2008

(51) Int. Cl.
*F01K 17/00* (2006.01)

(52) U.S. Cl. ..... 60/686; 60/688

(58) Field of Classification Search ..... 60/685–689
See application file for complete search history.

(56) References Cited

U.S. PATENT DOCUMENTS

| | | | | |
|---|---|---|---|---|
| 1,185,735 | A | | 6/1916 | Trood |
| 1,681,762 | A | | 8/1928 | Connet |
| 2,623,389 | A | | 12/1952 | Oosteroom |
| 2,772,567 | A | | 12/1956 | Boden |
| 2,975,635 | A | | 3/1961 | Kindler |
| 3,006,189 | A | | 10/1961 | Warren |
| 3,060,737 | A | | 10/1962 | Arragon |
| 3,075,383 | A | | 1/1963 | Favill |
| 3,782,113 | A | * | 1/1974 | Luongo ..... 60/689 |
| 3,934,471 | A | | 1/1976 | White |
| 3,940,058 | A | * | 2/1976 | Norris ..... 237/9 R |
| 4,080,790 | A | * | 3/1978 | Oberle ..... 60/661 |
| 4,653,321 | A | | 3/1987 | Cunningham |
| 4,739,647 | A | | 4/1988 | Monticelli |
| 4,829,831 | A | | 5/1989 | Kefer |
| 4,870,859 | A | | 10/1989 | Twerdochlib |
| 5,369,998 | A | | 12/1994 | Sowerby |
| 5,485,754 | A | | 1/1996 | Harpster |
| 5,487,311 | A | | 1/1996 | Guativa |
| 5,752,411 | A | | 5/1998 | Harpster |
| 5,792,963 | A | | 8/1998 | Baumann |
| 6,009,763 | A | | 1/2000 | Berckmans |
| 6,128,901 | A | | 10/2000 | Sha |
| 6,553,808 | B2 | | 4/2003 | Bonne |
| 6,963,809 | B2 | | 11/2005 | Matter |

* cited by examiner

*Primary Examiner* — Hoang M Nguyen
(74) *Attorney, Agent, or Firm* — Patrick J. Walsh

(57) ABSTRACT

A method and apparatus reliable, accurate and continuous measurement of air inleakage into the condenser of a steam-electric power plant with convenient monitoring by power plant personnel.

14 Claims, 2 Drawing Sheets

APPARATUS AND METHOD FOR MONITORING STEAM CONDENSER AIR INLEAKAGE

FIELD OF THE INVENTION

The invention relates to reliable, accurate and continuous measurement of air inleakage into the condenser of a steam-electric power plant with convenient monitoring by power plant personnel.

BACKGROUND OF THE INVENTION

The power cycle process in a steam-electric power plant starts at the source of heat. Within the boiler or steam generator, heat energy converts high pressure water into high energy steam with a substantial pressure and temperature. The steam is piped to a steam turbine, where the steam expands and flows through the turbine toward a condenser. The thermal energy of the steam acts on turbine blades and drives the turbine shaft. In the condenser, steam exhausted from the turbine is condensed to water and then ultimately pumped back to the boiler to repeat the power cycle.

The high-powered rotating action of the turbine shaft coupled to an electrical generator produces the plant's electrical generation that is sent out to homes, schools, and industries.

In accordance with the science of thermodynamics, maximizing the extraction of energy from steam within the turbine maximizes the power produced by the turbine (referred to as station generation). This requires the steam to be at the highest thermal energy level when it enters the turbine and at minimum energy when it reaches the turbine exit as the spent steam is discharged to the condenser. At the inlet (at throttle) of the steam turbine, the temperature and pressure energy of the steam is its maximum level consistent with plant design, metallurgy of the turbine, piping and valves, and reliable operation of both the boiler and the turbine. Conversely, at the exit of the turbine, pressure of the steam, well below atmospheric pressure, should be as low as practically achievable.

The condenser is a large heat exchanger directly connected to the turbine that condenses steam exhausted from the turbine and so sets the turbine exit pressure. The condenser is a shell and tube heat exchanger transferring heat from exhaust steam to cooling water flowing through thousands of small diameter tubes within the condenser shell. Condenser efficiency in transferring latent heat of condensation establishes condensation pressure. The lower the condensation pressure, the more efficient the condenser, and the more work the turbine can extract from the steam. Thus, condenser performance has an important influence on the plant generation.

Despite strict condenser maintenance programs, air leaks into the condenser through small cracks and penetrations in the shell or anywhere along the vacuum boundary due to the strong vacuum created within the condenser during the steam condensation process. Air inleakage is removed at the same rate at which it enters by air removal equipment—typically either steam jet air ejectors or vacuum pumps. With that recognition, condensers are designed with features to accommodate some air inleakage and non-condensables. Further, a nuclear steam electric power plant of the boiling water reactor (BWR) type produces a large quantity of non-condensable gases that flow with the steam into the condenser and also some feedwater treatment chemistry programs result in a small quantity of non-condensable gas being also carried by the steam. These non-condensables have the same effect on the condenser and are removed and measured in a similar manner. Hence, for simplicity, both the air inleakage and any applicable non-condensables will be combined to be termed as either air or air inleakage in the descriptions that follow herein.

As indicated in more detail later, the presence of excessive air inleakage interferes with the heat transfer efficiency of the condenser. That causes the condenser absolute pressure to rise and thereby reduces the power produced by the steam turbine. Thus it is imperative that the rate of air inleakage in the condenser be monitored to ensure it can be managed without adverse effects on the condenser performance and its condensation pressure.

As was indicated, air inleakage is removed at the same rate at which it enters the condenser spaces, typically by several sets of air removal equipment. Air removal equipment is located at the discharge end of piping connected to the central part of the condenser tube bundles that mark the collection point for the air and the end of the condensation path of most of the steam. By several different methods, air removal equipment compresses the collected condenser air leakage to a pressure slightly above atmospheric. The air removal equipment is either a form of compressor of one or two stages with an intercooler, a vacuum pump or is a steam jet air ejector of several stages with intermediate heat exchangers.

As a result of the natural compression process of the air removal equipment and its design, the majority of the vapor component drops out of the gas mixture. As a result, the original highly moisturized, variable character of the air-vapor flow from the condenser is mitigated by the time of its exit from the air removal equipment to a gas of moderately constant properties. That is, downstream of the air removal equipment, the condenser air inleakage, along with a small quantity of steam vapor and non-condensables, is a mixture of gas that is well-defined and always of relatively constant volumetric proportions. It is emphasized that this is in marked contrast to the irregular, fluctuating moisture content and droplets within the gas before it is compressed by the air removal equipment. Thus, along with a small amount of steam and potentially a slight amount of other non-condensables, the air removal equipment discharges a slightly moist air mixture to the ambient atmosphere at a slightly elevated temperature through outlet plant piping.

It is an important aspect of this invention to apply an air inleakage measuring instrument after the air removal equipment in order to ensure a more accurate and stable reading of the non-condensables and air inleakage gas ejected from the condenser than is measurable using a known technology. That known technology (Harpster U.S. Pat. No. 5,485,754) measures a flow with widely fluctuating properties by means of an instrument located before the gas mix is compressed and by air removal equipment.

It is to be noted that air is always present to a greater or lesser extent in the steam condensing inside the condenser due to the aforementioned leakage. Since air and non-condensables act as an insulating gas, the air in the mixture has a significant adverse effect on the condensation pressure if its quantity is excessive compared to the amount of steam. In fact it is surprising that when and where as little as a 1% air-steam mixture occurs in the condenser, it essentially reduces the local operating heat transfer coefficient to zero; that portion of the condenser tube surface becomes completely ineffective, there is little active steam flowing past the tubes of that local area and the region is considered to be air blanketed.

Consequently, in order to continue to condense the flow of steam exhausting from the turbine, the overall condenser pressure must increase, i.e., lose vacuum, to compensate for the loss of active tube surface area. That increases exhaust pressure and reduces plant generation. It is a function of the particular turbine response but an increase of 0.5 psi in condenser pressure generally will decrease the overall plant generation by 1% to 3.5% or increase the heat rate (the quantity of heat required to produce a unit of power) by the same percentage. To put this in perspective, for a 500 MW plant, a loss of 0.5 psi could be worth from $1,000 to $50,000 a day using current utility economics. Further, in certain instances the air inleakage is so great that the loss in condenser vacuum exceeds the turbine maximum exhaust pressure limit and the station must reduce the load or shut down until all major air leaks are found and repaired.

There are also other adverse effects of air inleakage in an operating steam-electric power plant. Depending upon where inside the condenser air blanketing exists and its relative quantity, its presence may also increase the subcooling of the condensate. Subcooling is defined as the temperature difference between the actual condensate temperature and that corresponding to the saturation pressure of the steam as it enters the condensate tube bundle. In this case, as the condensate falls by gravity toward the hotwell below, it cools when striking relatively cold tube surfaces in regions that are air blanketed. If the air blanketing region occurs in the lower section of the condenser tube bundle, there is no opportunity for reheating that condensate back up to the condenser operating saturation temperature by direct contact with active steam flow and so the condensate drops into the hot well pool at a relatively cool temperature. The condensate must be later reheated and converted to steam, and the cooler it is returned to the boiler, the more heat must be added. Therefore, if subcooling occurs, extra heat must be added to the power cycle to maintain the same generation. As a result its occurrence must be minimized for efficient operation.

The last detrimental effect of air inleakage comes from oxygen present in the air. Oxygen within the air is absorbed into the condensate while the condensate drips and flows through tube bundle areas of high air concentration. Dissolved oxygen increases internal corrosion of piping and components downstream of the condenser such as the boiler or steam generator and turbine within the power cycle, and must be avoided.

Since all the cited effects of air inside the condenser are detrimental, power plant operators require a reasonably accurate measure of air inleakage in order to take an appropriate action in a timely fashion.

Since the quantity of air inleakage to be measured is dependent on the size of the plant, some quantitative perspectives follow: For a small 10 Megawatt (MW) plant, the normal air inleakage may range from 1 to 5 standard cubic feet per minute (SCFM); the air inleakage would be considered excessive if above 10 SCFM. (The SCFM is referenced to dry air at 14.7 psia and 70 F by the condenser industry). A large 1000 MW fossil or nuclear plant would normally tolerate a 20 SCFM air inleakage and it would not be considered excessive until it reached 40 SCFM. The non-condensable gas generated by a 1000 MW nuclear BWR could amount to as much as 3 times the quantity of air leaked into the condenser vacuum space. Its quantity would be estimated from nuclear reactor power estimates and would not be affected by typical 15 to 25 SCFM air leaks. A medium sized fossil plant, selected as 600 MW, would normally have an air inleakage of 15 SCFM. No action would be considered however until the latter air inleakage reached a value of approximately 30 SCFM.

The invention and method to be described would be applicable to all the above plants and sizes.

As follows, for several important reasons plant operators must periodically know the approximate air inleakage into their condenser to determine:

1) whether the air inleakage is at an acceptable level;

2) whether the rate of inleakage is increasing and how quickly;

3) whether air leak detection and repair programs should be initiated;

4) whether or not to put another set of air removal equipment into service;

5) whether the level of air leakage explains a high condenser pressure or other plant performance problem;

6) whether the inleakage is severely impacting feedwater chemistry;

or 7) whether the air leak is so excessive that the plant must be shut down until the leak is located and repaired.

Plant operators have always had difficulty in reliably and accurately measuring the condenser air inleakage. The prior patent art with respect to this measurement is either not reliable, is inaccurate, is unable to communicate with a plant digital control system (DCS) or requires a manual, subjective collection process.

One class of instruments commonly supplied with the air removal equipment to measure air inleakage to a condenser includes rotameters and flow measurement orifices. A rotameter is a graduated, vertical tapered tube with an internal float that becomes suspended at a certain level by the velocity of gas flowing upward through the tube. Such rotameters and orifices are located just downstream of the air removal equipment with small diameter piping runs that bypass normal plant exhaust vent piping.

As described, to maintain accuracy of the condenser air inleakage measurement, some of the prior patent art addresses a method of remotely controlling and quickly switching from an initial vent pipe run to another using valves and other methods. This art is not applicable to the normal steam-electric power plant operation described herein. There is no current or past interest in controlling automatic valves or other devices that switch quickly to another parallel pipe run or otherwise to improve the accuracy of a particular air inleakage measurement during operation. The several valves near the air removal equipment allow air inleakage rotameters or orifices to be physically measured. These are manually operated valves and no control, switching or other means is provided or necessary to improve measurement accuracy.

The entire class of rotameters and orifices described above have been found in practice to be inaccurate and unreliable for the following reasons:

1. They require the normal air removal equipment exhaust piping to the atmosphere to be valved-out manually and the flow re-routed through the instrument. Often the isolation valve does not close properly and much of the air to be measured is bypassed.

2. Due to the slight difficulty of calibration with the low density mix of warm air and steam vapor exhausting from a condenser, for reasons of economy, these instruments are often supplied uncalibrated.

3. Over time, the instruments become unreadable and unreliable.

4. The somewhat tortuous, small diameter bypass piping route of the exhaust flow that is required to be used in order to measure the air inleakage flow introduces a moderate added discharge pressure to the air removal equipment. That extra pressure loss may effect the performance characteristic of the air removal equipment and temporarily change the quantity of air it pumps to cause a misleading measurement.

5. These classic measurement methods are physically remote from the control room (the nerve center of the plant), are manually performed and recorded, are open to interpretation and take time to be conducted and reported to operation. The loss of time and subjective nature of the readings obtained generally make the measurement one of lower quality and credibility.

The prior art described above is thus found to be inapplicable, inadequate or unreliable to deal with the problem of accurately measuring condenser air inleakage.

Some of the recent prior art (Harpster patent cited above) in this sector of technology has produced instrumentation that represents an alternate to the traditional methods described above. Such instrumentation measures the air inleakage in the vacuum piping leading from the condenser to the air removal equipment. As follows, this instrumentation however is subject to such a stringent and extremely variable environment that in practice, its measurements may also become inaccurate or unreliable.

The air-vapor off-take piping from the condenser to the air removal equipment is under a high vacuum during operation. The flow at that location is of a turbulent Reynolds Number of 15,000 or more, a low density that may vary typically from 0.0015 to 0.0070 lb/ft$^3$ and of a moderate velocity of up to 100 ft/sec. Over time however, the flow is an exceedingly variable mixture comprised of steam, water and moisture droplets, air inleakage with a trace of other non-condensable gases like ammonia and if applied to a nuclear plant, other non-condensable gases such as hydrogen and oxygen. The proportion of vapor in this mix is usually very large. Valves and elbows in the line are necessary as it snakes out from the condenser to the air removal equipment.

The cited recent prior art locates a measurement probe at a center point location someplace within this pipe and measures the quantity of air inleakage, the quantity of steam vapor, the relative humidity of the air-vapor gas, the static pressure and the temperature of the mixture under vacuum conditions. The readings may often be inaccurate and unreliable because:

1. Fundamentally, the probe measurements are based on dry, hot wire anemometer technology that is extrapolated to encompass wet steam mixtures by using empirical calculations. The calibrations would theoretically account for an expected large evaporative heat transfer coefficient (in contrast with a dry hot film anemometer) but which in practice are not capable of accommodating all the occurrences of significant moisture and probe-drenching water droplets in the gas flow.

2. The wide variation in the gas mixture properties and mass proportions travelling within the line. Over time the flow can be almost 100% saturated or supersaturated steam, a two-phase flow with droplets or a mix of mostly air depending on level of air inleakage, the condenser design, the condenser pressure, the operating load and the volume capability of the air removal equipment. The empirical correlations and inherent design of the prior art are unable to function accurately within that enormous diversity of typical condenser vacuum conditions.

3. The build-up of evaporative solids in time on the probe that effect its ability to accurately measure mass velocities.

4. The sensitive empirical coefficients needed for the probe calibration are subject to sufficient experimental uncertainty that may render the probe measurements inaccurate for a particular gas condition.

5. Due to its installed bands and valves, there can be a large variation in the velocity profile across the pipe that runs from the condenser to the air removal equipment. If this is the case, the single center point measurement employed by the prior art would not correctly reflect the average flow velocity. Flow measurements with single port probes, like a pitot tube, require a traverse of several points across a conduit for accuracy.

The operational variable that is of prime importance to power plant operators however is the air inleakage. Among the prior patent art that was cited of this latter type, air inleakage is only one of the several parameters those inventions measure under vacuum conditions inside the line leading from the condenser to the air removal equipment. Because of the widely varying air-vapor-droplet flow conditions directly from the condenser, the inherent incapability of the invention hardware itself and the methods incorporated by the previous inventions as indicated above, that prior art is found to be inadequate and unreliable to deal with the problem of accurately measuring the air inleakage and non-condensables.

SUMMARY OF THE INVENTION

This invention accurately, reliably and continuously monitors the non-condensables and air inleakage into the condenser of a steam-electric power plant. This invention comprises an installed self-contained flow measurement section that utilizes a novel, non-traditional averaging flow velocity measurement element in a novel location within the plant atmospheric exhaust line. The invention's measurement of the volume of air inleakage is accurate and it generates a continuous electronic signal capable of being transmitted either to a local read-out, to the control room or another location for review and/or action by plant operators or others. This invention is designed and intended to be installed in a non-traditional, novel power plant location wherein the condition of the gas that is there exhausted to the environment is relatively benign since it is only at slightly above atmospheric pressure and since the properties of the gas at this point are very predictable, relatively constant and contain no large amounts of moisture.

A preferred embodiment of the apparatus according to the invention is a housing situated in a steam-electric power plant atmospheric exhaust line downstream of air removal equipment engaged in removing air, non-condensables, and steam mixture from a condenser for discharge to the atmosphere. Preferably, the housing is an integral section of the atmospheric exhaust line for enclosing and internally supporting a propeller type anemometer centrally, i.e., axially in the discharge line. The anemometer produces a signal in direct proportion to its rotational speed that is in turn proportional to the volume of exhaust air mixture flowing through the housing. The signal is continually transmitted to a plant collection data system for observation and analysis of air inleakage and non-condensable gas removal data.

The invention is applicable to all steam-electric power plants whether of the nuclear, fossil, combined-cycle or waste-to-energy types. In these plants, the generation produced by the steam turbine depends strongly upon the efficient operation of the condenser.

OBJECTS OF THE INVENTION

An object of the invention is to provide reliable and accurate continuous measurement of non-condensables and air inleakage into a steam-electric power plant condenser.

Another object of the invention is to take air inleakage data from a location in power plant equipment so as to ensure that an exhaust volume of substantially constant density, humidity and temperature is the basis for measurement.

Another object of the invention is to provide convenient monitoring of air inleakage data by plant personnel on a continuing basis.

Another object of the invention is to provide measurement of condenser air inleakage data that can be monitored or stored electronically.

Another object of the invention is to provide measurement of air inleakage volume to a greater degree of accuracy by improving uniformity of exhaust velocity profile.

Another object of the invention is to provide measurement of air inleakage volume to a greater degree of accuracy by means of a temperature sensor for a more exact estimate of the moisture content of exhaust gas.

Other and further objects of the invention will become apparent with an understanding of the following detailed description of the invention or upon employment of the invention in practice.

DETAILED DESCRIPTION OF PREFERRED EMBODIMENT

A preferred embodiment of the invention has been chosen for detailed description to enable those having ordinary skill in the art to which the invention appertains to readily understand how to construct and use the invention and is shown in the accompanying drawing in which.

Figure 1:
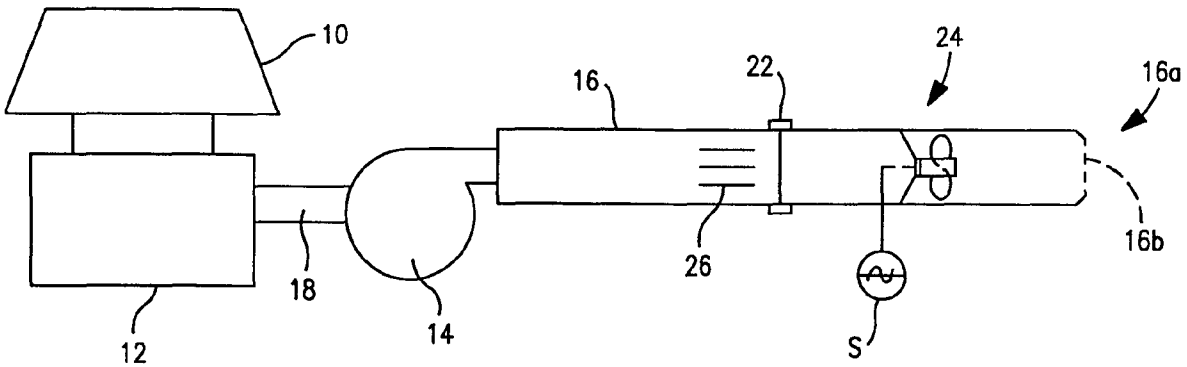
FIG. 1 is schematic view of the present invention in relation to accompanying power plant equipment.
Figure 2:
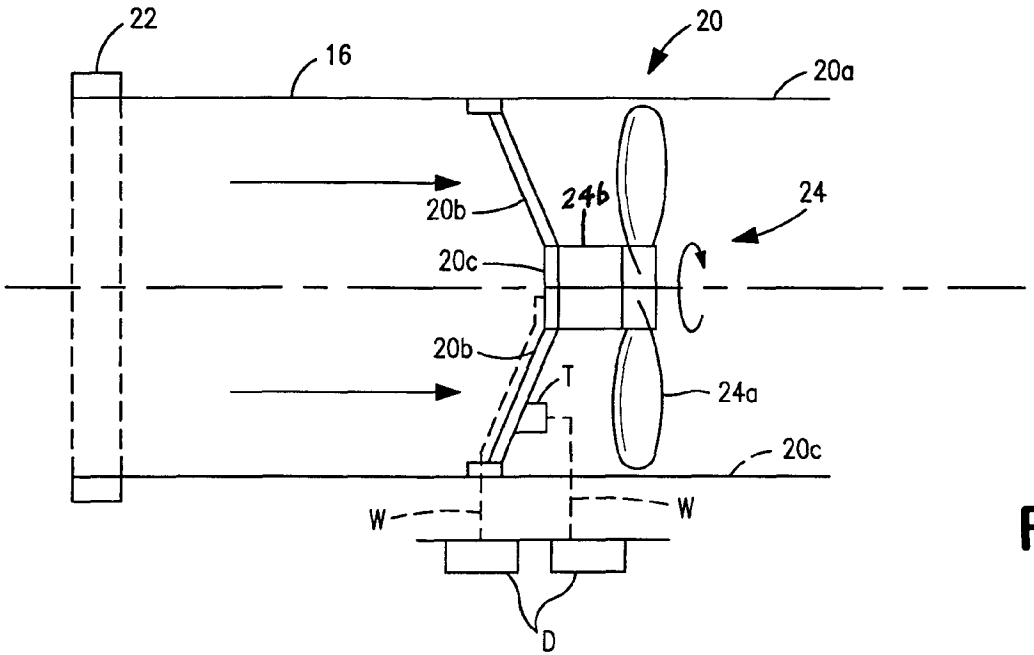
FIG. 2 is a schematic view of flow metering assembly according to the invention for monitoring steam condenser air inleakage.

Referring now to the drawing, a preferred embodiment of the invention is installed in a conventional steam-electric power plant consisting of steam turbine 10, condenser 12, air removal equipment 14, and plant atmospheric exhaust line 16. An off-take line 18 connects condenser and air removal equipment for removal from the condenser of an exhaust flow consisting of air inleakage, a remaining quantity of steam vapor and usually a small quantity of non-condensable gas such as ammonia. In the air removal equipment the mixture of air, non-condensables and remaining steam are compressed to a pressure slightly above atmospheric with the majority of the steam being condensed. The final pressure of the process downstream of the air removal equipment is just sufficient to overcome any losses in the piping system as the air and non-condensables exhaust to the environment. Usually this pressure is from 0.1 to 3.0 psig with, as has been indicated, most of the steam having been condensed and removed in the compression process. If applied to a BWR nuclear plant, the air and non-condensables removed are radioactive and must be treated further before being released to the environment. In this special case, because of the pressure loss through the components within the off-gas system, the exit pressure in the air removal exhaust line might be as high as 8 psig. The exhaust flow passes through lengthy plant atmospheric exhaust lines and at entry into the atmosphere 16*a* the exhaust flow consists of removed air inleakage with a trace of non-condensable gas and is saturated with moisture within a tight range by weight (normally from 5% to 8%) and within a moderate span of temperature (normally from 120° F. to 150° F.).

A preferred embodiment of flow metering assembly 20 according to the invention is installed at the end of the plant exhaust line 16 by means of a collar 22 or other joint mechanism, and is of the same diameter as the main run of plant piping. The flow metering assembly may in fact be installed anywhere along atmospheric exhaust line as a short flow-metering section. Alternatively, the assembly can be of a reduced or larger diameter than the exhaust line to accommodate specific plant requirements for installation using an appropriate reducer or diffuser to minimize pressure loss. As an alternative embodiment, it may also be designed to be portable, then temporarily connected and held manually to provide a current snapshot of the air inleakage and non-condensables of a particular condenser.

The basic components of the flow metering assembly 20 are housing 20*a* in the form of a length of piping or duct having internal supports preferably in the form of radial struts 20*b* and support ring 20*c* for positioning an anemometer 24 centrally (i.e., axially) in the housing. Typically, there are three or four struts on equal circumferential spacing for positioning the support ring axially of the exhaust line 16. The anemometer is commercially available and includes a propeller 24*a* with a blade diameter equal to the inside diameter of housing 20*a* less operating clearance together with a signal generator. The anemometer is a propeller driven, low inertia type calibrated to produce a signal in proportion to its rotational speed that is in turn proportional to the exhausted air mixture volume flowing through the assembly in cubic feet per minute (cfm). The signal generated can be either an amperage or voltage signal. The flow metering assembly optionally may include a temperature sensor to more accurately compute the condenser air inleakage by a more exact estimate of the moisture component of the gas. That is, the air discharged from the air removal equipment is usually saturated with vapor at the temperature and pressure of the discharge (slightly above local atmospheric pressure). Temperature indicates the partial gas pressure which tells the volume of vapor in air/vapor exhaust flow.

As a further aid to improving the overall accuracy of volume measurement by improving uniformity of exhaust velocity profile, flow straighteners 26 may be included in the assembly at the upstream attachment end of housing to exhaust piping. In any case, the assembly and device produce only a relatively low inherent pressure resistance to the flow in the atmospheric exhaust line.

By standard, well-known electrical/mechanical methods and equipment, the anemometer signal S and the optional temperature signal T are either hard wired or wirelessly connected to the plant data collection system D for monitoring use by the operators or others in the control room or at, any other location and at the same time, as elected by the plant, recorded for local read-out and/or stored in a computer for a review of historical treads or other uses. The anemometer propeller 24*a* and signal generator 24*b* may be enclosed in a subassembly that if necessary can be removed during plant operation and services, adjusted, repaired or replaced.

It is also desirable to install a screen 16*b* at the discharge end to keep birds and large insects from entering the flow metering section. A small drain hole 20*c* is located in the bottom of the housing to drain away any moisture collecting there.

In consideration of its particular structural and environment requirements, the flow metering assembly 20 can be fabricated of any number of strong, reliable materials including various metals, fiberglass or plastics such as ABS, CPVC and PVC. The propeller anemometer is constructed of suitable material that can withstand the modest temperature and humidity conditions inside the exhaust line downstream of the air removal equipment and for the range of pressures indicated previously. If applied to a BWR, the materials above could be also selected to suitably withstand the effects of radiation. The propeller anemometer technology has advanced significantly in recent years. No special design of the anemometer is expected because for example, despite moisture, sea spray, and other aspects of this sometimes harsh environment, these unattended velocity measuring devices are used now by meteorologists to reliably determine ocean winds on buoys out at sea. These classes of calibrated anemometers have not however been used in power plants except for measurement of the local wind speeds outside the plant buildings.

Figure 3:
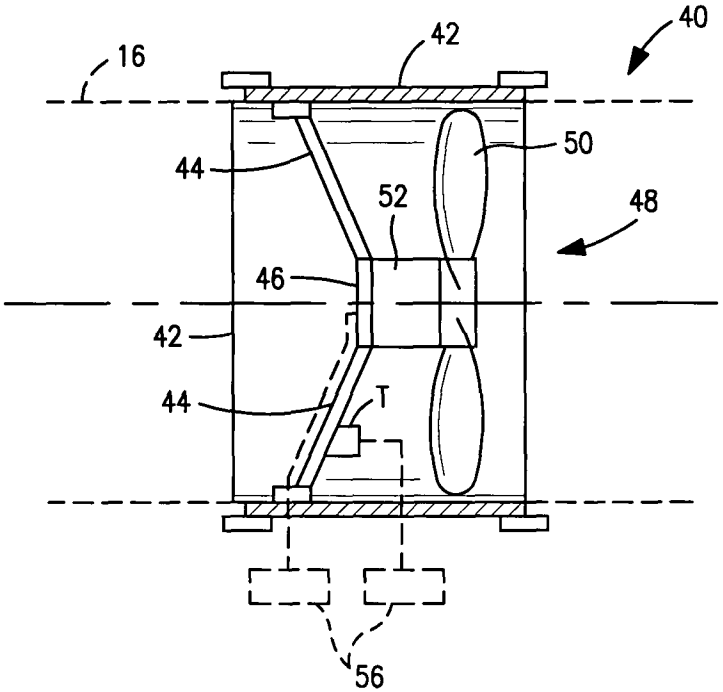
FIG. 3 is a schematic view of a modified embodiment of the invention as a portable apparatus for temporary installation in an exhaust line.

The apparatus may also be constructed to be a portable embodiment of the monitor that can be temporarily applied and moved from generating unit to unit or plant to plant with either a local readout, a plug-in to the plant or other data collection system or a wireless hookup to the control room. As shown in FIG. 3 a portable embodiment of flow metering assembly 40 comprises housing 42 in the form of a length of piping or duct having internal supports preferably in the form of radial struts and support ring 46 for positioning an anemometer 24 centrally (i.e., axially) in the housing. Typically, there are three or four struts on equal circumferential spacing for positioning the support ring axially of the housing. An anemometer 48 is mounted in support ring 46 includes a propeller 50 with a blade diameter equal to the inside diameter of the housing less operating clearance together with a signal generator 52. The anemometer is a propeller driven, low inertia type calibrated to produce a signal in proportion to its rotational speed that is in turn proportional to the exhausted air mixture volume flowing through the assembly, in cubic feet per minute (cfm). The signal generated can be either an amperage or voltage signal. The flow metering assembly optionally may include a temperature sensor T to more accurately compute the condenser air inleakage by a more exact estimate of the moisture component of the gas.

The portable apparatus is fitted with mounting fasteners or rings 54 for securing the device in exhaust line 16.

The portable apparatus is fitted with means 56 for local readout, a plug-in to the plant or other data collection system, or a wireless hookup to the control room for air inleakage monitoring.

The application of the propeller anemometer to this is unique and has the advantages of:

- proven reliability of its design, its moving parts and its signal generation,
- a rotational speed that closely captures the average value of the entire velocity profile in contrast to reacting only to a velocity at one point,
- an inherent accuracy that can be calibrated to the expected modest but constant density, humidity and temperature in the exhaust volume,
- the embodiment of a mechanical velocity measurement mechanism that provides accurate readings in both a dry or moist environment in comparison to stationary probes that can result in enormous readings when in a moist environment,
- being a moving device with no temperature differential between it and the gas so that it will not be prone to inaccurate measurements due to mineral scale formations that can occur on the elevated temperature stationary probes used by some of the previous art or hot wire anemometers,
- representing a very open flow metering section that creates only a minimal extra pressure loss resistance, even if the section has a different diameter than the main run of exhaust piping,
- having a rotational start threshold that would be below air inleakage levels of interest to the plant operators, and
- producing an electronic signal that can easily be processed and converted to several air inleakage units of interest to the plant like SCFM, lbs/hr, etc., and also digitized and stored by a plant computer.

The present invention provides a method for measuring air inleakage of a steam-electric power plant condenser comprising the steps of removing from the condenser an exhaust flow of air inleakage, steam vapor, and non-condensable gas; compressing the exhaust flow to a pressure slightly above atmospheric to condense and remove most of the steam from exhaust flow; directing the exhaust flow to atmosphere through an exhaust line; utilizing the exhaust flow through the exhaust line to rotate a signal generator, generating a signal that is proportional to rotational speed of the generator and that is in turn proportional to exhaust flow volume through the exhaust line; and sensing the temperature of exhaust flow so as to determine precisely the air inleakage component of exhaust flow.

Various changes may be made to the structure embodying the principles of the invention. The foregoing embodiments are set forth in an illustrative and not in a limiting sense. The scope of the invention is defined by the claims appended hereto.

We claim:

1. An apparatus for monitoring steam condenser air inleakage comprising means for: (a) removing from the condenser an exhaust flow of air inleakage, steam vapor and non-condensable gas, (b) compressing the exhaust flow to a pressure slightly above atmospheric thereby condensing and removing steam vapor, and (c) for discharging the exhaust flow to atmosphere through an exhaust line, a signal generator situated in the exhaust line, the signal generator responsive to exhaust flow through the exhaust line to produce a signal proportional to exhaust air mixture volume in cfm flowing to atmosphere.

2. An apparatus as defined in claim 1 which further includes a temperature sensor whereby to determine partial pressure and volume of vapor in exhaust flow the more precisely to determine air inleakage in exhaust flow.

3. An apparatus for monitoring steam condenser air inleakage comprising air removal equipment for removing from the condenser an exhaust flow of air inleakage, steam vapor and non-condensable gas, compressing the exhaust flow to a pressure slightly above atmospheric thereby condensing and removing steam vapor, and for discharging the exhaust flow to atmosphere through an exhaust line, an anemometer situated in the exhaust line, the anemometer having a propeller and signal generator responsive to exhaust flow through the exhaust line to produce a signal proportional to exhaust air mixture volume flowing to atmosphere.

4. An apparatus as defined in claim 3 which further includes a temperature sensor whereby to determine partial pressure and volume of vapor in exhaust flow the more precisely to determine air inleakage in exhaust flow.

5. An apparatus for monitoring steam condenser air inleakage comprising air removal equipment for removing from the condenser an exhaust flow of air inleakage, steam vapor and non-condensable gas, compressing the exhaust flow to a pressure slightly above atmospheric in a range from 0.1 to 0.3 psig thereby condensing and removing steam vapor, and for discharging an exhaust flow to atmosphere through an exhaust line with the exhaust flow saturated 5 to 8% by weight with moisture and with a temperature of from 120° F. to 150° F., an anemometer situated in the exhaust line, the anemometer having a propeller and signal generator responsive to exhaust flow through the exhaust line to produce a signal proportional to exhaust air mixture volume flowing to atmosphere, and a temperature sensor for indicating vapor so as to provide a precise value for air inleakage in the exhaust flow.

6. An apparatus for monitoring steam condenser air inleakage comprising air removal equipment for removing from the condenser an exhaust flow of air inleakage, steam vapor and non-condensable gas, compressing the exhaust flow to a pressure slightly above atmospheric in a range from 0.1 to 0.3 psig thereby condensing and removing steam vapor, and for discharging an exhaust flow to atmosphere through an exhaust line with the exhaust flow saturated 5 to 8% by weight with moisture and with a temperature of from 120° F. to 150° F., an anemometer situated in the exhaust line, the anemometer having a propeller and signal generator responsive to exhaust flow through the exhaust line to produce a signal proportional to exhaust air mixture volume flowing to atmosphere, and a temperature sensor for indicating vapor so as to provide a precise value for air inleakage in the exhaust flow.

7. An apparatus for monitoring steam condenser air inleakage comprising air removal equipment for removing from the condenser an exhaust flow of air inleakage, steam vapor and non-condensable gas, compressing the exhaust flow to a pressure slightly above atmospheric thereby condensing and removing steam vapor, and for discharging an exhaust flow to atmosphere through an exhaust line with the exhaust flow saturated 5 to 8% by weight with moisture and with a temperature of from 120° F. to 150° F., an anemometer supported axially in the exhaust line by means of a plurality of radial struts supporting a mounting ring for receiving the anemometer, the anemometer having a propeller driven by exhaust flow for rotating a signal generator, the signal generator for producing an electric signal proportional to exhaust air mixture volume flowing to atmosphere, and a temperature sensor for indicating vapor so as to provide net value for air inleakage in the exhaust flow.

8. An apparatus for monitoring steam condenser air inleakage in a steam electric power plant having:

(i) a steam condenser;

(ii) means for removing from the condenser an exhaust flow of air inleakage, steam vapor and non-condensable gas, compressing the exhaust flow to a pressure slightly above atmospheric thereby condensing and removing steam vapor, and;

(iii) an exhaust line for discharging the exhaust flow to atmosphere, the apparatus comprising a signal generator situated in the exhaust line, the signal generator responsive to exhaust flow through the exhaust line to produce a signal proportional to exhaust air mixture volume in cfm flowing to atmosphere.

9. An apparatus for monitoring steam condenser air inleakage having:

(a) air removal equipment for removing from the condenser an exhaust flow of air inleakage, steam vapor and non-condensable gas, compressing the exhaust flow to a pressure slightly above atmospheric in a range from 0.1 to 0.3 psig thereby condensing and removing steam vapor, and for discharging an exhaust flow to atmosphere through an exhaust line with the exhaust flow saturated 5 to 8% by weight with moisture and with a temperature of from 120° F. to 150° F., and (b) the apparatus for monitoring comprising an anemometer situated in the exhaust line, the anemometer having a propeller and signal generator responsive to exhaust flow through the exhaust line to produce a signal proportional to exhaust air mixture volume flowing to atmosphere, and a temperature sensor for indicating vapor so as to provide a precise value for air inleakage in the exhaust flow.

10. A portable apparatus for monitoring steam condenser air inleakage in a steam electric power plant having air removal equipment for removing from the condenser an exhaust flow of air inleakage, steam vapor and non-condensable gas, for compressing the exhaust flow to a pressure slightly above atmospheric thereby condensing and removing steam vapor, and for discharging the exhaust flow to atmosphere through an exhaust line, the portable apparatus comprising an anemometer having a housing adapted to be inserted in the exhaust line, the housing being a section of exhaust line so that when inserted it becomes part of the exhaust line for discharging exhaust flow to atmosphere, the anemometer having a propeller and signal generator responsive to exhaust flow through the exhaust line to produce a signal proportional to exhaust air mixture volume flowing to atmosphere.

11. An apparatus as defined in claim 10 which further includes a temperature sensor whereby to determine partial pressure and volume of vapor in exhaust flow the more precisely to determine air inleakage in exhaust flow.

12. A method for measuring air inleakage of a steam-electric power plant condenser comprising the steps of removing from the condenser an exhaust flow of air inleakage, steam vapor, and non-condensable gas; compressing the exhaust flow to a pressure slightly above atmospheric to condense and remove most of the steam from exhaust flow; directing the exhaust flow to atmosphere through an exhaust line; utilizing the exhaust flow through the exhaust line to rotate a signal generator, generating a signal that is proportional to rotational speed of the generator and that is in turn proportional to exhaust flow volume through the exhaust line; and sensing the temperature of exhaust flow so as to determine precisely the air inleakage component of exhaust flow.

13. A method as defined in claim 12 which includes the step of sensing the temperature of exhaust flow so as to determine vapor component and the air inleakage component of exhaust flow.

14. A method for measuring air inleakage and radiological non-condensable gases from a nuclear BWR steam-electric power plant condenser comprising the steps of removing from the condenser an exhaust flow of air inleakage, steam vapor, and non-condensable radioactive gases; compressing the exhaust flow to a pressure slightly above atmospheric to condense and remove most of the steam from exhaust flow; directing the exhaust flow to the off-gas system through an exhaust line; utilizing the exhaust flow through the exhaust line rotate a signal generator, generating a signal that is proportional to rotational speed of the generator and that is in turn proportional to exhaust flow volume through the exhaust line; and sensing the temperature of exhaust flow and other parameters so as to determine precisely the air inleakage component of exhaust flow and the quantities of radiological oxygen and hydrogen.

* * * * *